US008544906B2

(12) United States Patent
Northrop et al.

(10) Patent No.: US 8,544,906 B2
(45) Date of Patent: Oct. 1, 2013

(54) WASTE COLLECTOR

(75) Inventors: Melaney Northrop, Mansfield, TX (US); Adam Weber, Keller, TX (US)

(73) Assignee: Doskocil Manufacturing Company, Inc., Arlington, TX (US)

( * ) Notice: Subject to any disclaimer, the term of this patent is extended or adjusted under 35 U.S.C. 154(b) by 85 days.

(21) Appl. No.: 12/874,980

(22) Filed: Sep. 2, 2010

(65) Prior Publication Data

US 2011/0049917 A1 Mar. 3, 2011

Related U.S. Application Data

(63) Continuation-in-part of application No. 29/359,150, filed on Apr. 6, 2010, now Pat. No. Des. 634,490.

(60) Provisional application No. 61/239,331, filed on Sep. 2, 2009, provisional application No. 61/321,387, filed on Apr. 6, 2010.

(51) Int. Cl.
*A01K 29/00* (2006.01)

(52) U.S. Cl.
USPC ..... 294/1.4

(58) Field of Classification Search
USPC ..... 294/1.3, 1.4, 1.5, 209; 15/104.8, 15/257.1, 257.2, 257.7; 119/161, 867; 220/908.1, 495.11, 495.08
See application file for complete search history.

(56) References Cited

U.S. PATENT DOCUMENTS

| | | | | |
|---|---|---|---|---|
| 3,503,535 | A * | 3/1970 | Sparks, Sr. | 220/326 |
| 3,827,098 | A * | 8/1974 | Sanderson | 294/1.4 |
| D285,012 | S * | 8/1986 | Willis | D30/162 |
| 4,741,566 | A * | 5/1988 | Byung-Do et al. | 294/1.4 |
| 5,513,883 | A * | 5/1996 | Segla | 294/9 |
| 5,702,138 | A | 12/1997 | Elkind | |
| 5,799,993 | A * | 9/1998 | Lafferty | 294/1.4 |
| 5,868,447 | A | 2/1999 | Clark et al. | |
| 6,474,495 | B1 * | 11/2002 | Frei | 220/495.08 |
| 2002/0167184 | A1 * | 11/2002 | May | 294/1.4 |
| 2004/0164568 | A1 | 8/2004 | Diehl | |
| 2004/0189026 | A1 | 9/2004 | Denham et al. | |
| 2005/0071943 | A1 * | 4/2005 | Liu | 15/257.2 |

OTHER PUBLICATIONS

International Search Report, PCT/US2010/047731, mailed Oct. 18, 2010.

* cited by examiner

*Primary Examiner* — Stephen Vu
(74) *Attorney, Agent, or Firm* — Eckert Seamans Cherin & Mellott, LLC; Brij K. Agarwal

(57) ABSTRACT

A waste removal system including a waste container configured to secure a bag having handles. The waste container includes a set of sidewalls having a set of engagement features or hooks. There is a engagement feature or hook located on each sidewall and the engagement features are spaced away from the sidewalls, creating an area where the handles for the bag may be secured. The container also includes a lid operatively attached to the sidewalls. When the container is in a first position, the lid partially covers the opening and when the container is in a second position the opening is uncovered.

9 Claims, 8 Drawing Sheets

WASTE COLLECTOR

CROSS-REFERENCE TO RELATED APPLICATIONS

This Application claims the benefit under 35 U.S.C. §119(e) to U.S. Provisional Patent Application No. 61/239,331, which was filed Sep. 2, 2009, and entitled "Pet Waste Collection Tools," which application is incorporated by reference herein in its entirety.

Additionally, this Application claims the benefit under 35 U.S.C. §119(e) to U.S. Provisional Patent Application No. 61/321,387, which was filed Apr. 6, 2010, and entitled "Pet Waste Collector," which application is incorporated by reference herein in its entirety.

Additionally, this application is a continuation-in-part of U.S. patent application Ser. No. 29/359,150, filed Apr. 6, 2010, and entitled "Pet Waste Collection Tool," which application is incorporated by reference herein in its entirety.

FIELD OF THE INVENTION

The present invention relates to waste cleanup tools. More specifically, the present invention relates to a device for picking up solid pet waste.

BACKGROUND

Pets, such as dogs, relieve themselves in places such as their owner's backyards, city sidewalks, parks, etc. Many times owners have the responsibility to clean up after their pets. However, cleaning up pet solid waste can be a messy procedure. For example, some "poop scoopers" may effectively clean the waste off of the ground, but after the scooper has removed the waste, the waste must be disposed. Generally, with current poop scoopers the owner may take frequent trips to the trash or other waste collection areas to dispose of each piece of waste separately. Also, often when the owner attempts to dispose of the waste, it may stick to the container. Once waste sticks to the scooper it may emit strong odors, as well as make it more difficult to further clean up pet waste. In particular, the owner may be left to scraping the inside of the container to remove the waste and place it in the trash, further dirtying the container and possibly other tools used in the process.

BRIEF SUMMARY

According to some embodiments, a pet waste removal container having a front wall, bottom wall and sidewalls is disclosed. The container includes an opening for receiving pet waste. The sidewalls may include a set of engagement features (or hooks) that are located a set distance away from the sidewalls, creating a space between the engagement features and the sidewalls. A lid is operatively attached to the sidewalls such that when the container is in a first position the lid partially covers the opening and when the waste container is in a second position the lid uncovers the opening. The waste container may further include a handle attached to the lid. A bag, such as a disposable plastic grocery bag, may be secured to the waste container via the engagement features, such that the bag rests inside of the opening, but is secured on the outside of the sidewalls to the engagement features.

While multiple embodiments are disclosed, still other embodiments of the present invention will become apparent to those skilled in the art from the following Detailed Description. As will be realized, the embodiments are capable of modifications in various aspects, all without departing from the spirit and scope of the embodiments. Accordingly, the drawings and detailed description are to be regarded as illustrative in nature and not restrictive.

DETAILED DESCRIPTION

Figure 1:
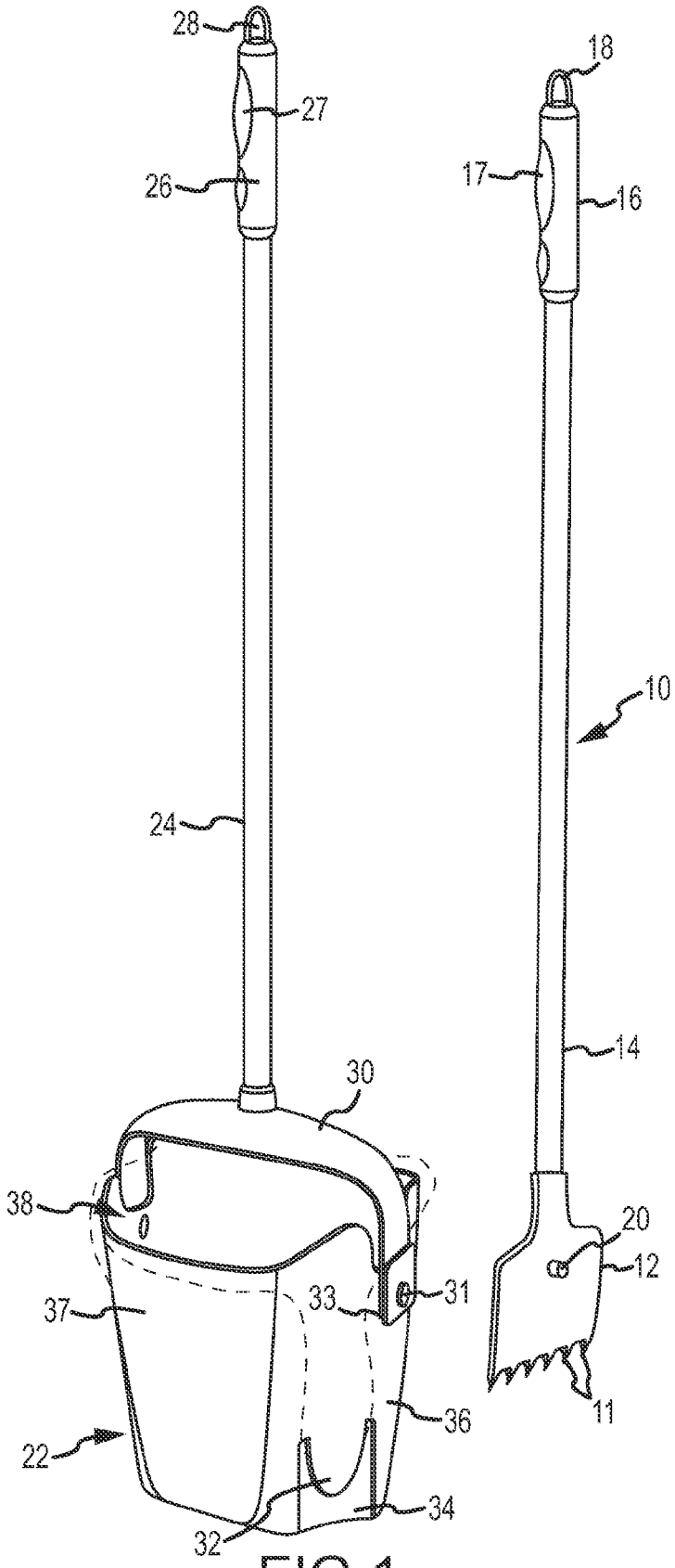
FIG. 1 is front perspective view of some embodiments of the waste removal system.

Disclosed herein is a solid waste removal system. The removal system includes a waste container attached to a handle. In some embodiments, the waste container may have a generally rectangular shaped container having a large opening for holding waste. The waste container may include engagement features located on an outer sidewall of the waste container. The engagement features may be used to secure a disposable bag to the outside sidewalls of the waster container. For example, the engagement features may be configured to secure a disposable bag. In some embodiments, the engagement features may be configured to secure bags having handles, such as a plastic grocery bags, while in other embodiments, the engagement features may be configured to secure bags without handles. The attached disposable bags may substantially wrap around the sidewalls of the container and an opening of the bag may be held open within the waste container. Additionally, in some embodiments, the bag may be secured in a manner that at least partially covers a lid and handle.

The waste removal system may also include a lid connected to the waste container and a handle. The waste container may be configured to move relative to the lid. For example, in some embodiments the waste container may be configured to rotate relative to the lid. In particular, in some embodiments, the waste container may generally be configured to self-orient in a vertical (or nearly vertically upright) position when elevated off the ground and to rotate when placed on the ground so that the opening is parallel to the ground and a front wall rests on the ground. With the front wall of the container resting on the ground and the waste container generally parallel to the ground, waste may be easily scooped or raked into the container.

The handle extends from the container to allow a user to stand in order to clean the waste. In some embodiments, the handle may have telescoping elements that allow for the distance between the handle and the container to be adjusted. In some embodiments, the handle may include one or more extensions that may attach to the handle to allow for extension of the handle from the container.

Once waste has been scooped into an open bag installed on the container, the handles of the bag may be removed from the engagement features and the bag may be disposed. Thus, the waster removal system allows a user to easily remove pet waste, without having the pet waste directly contacting the walls of the waste container, as well as allowing for easy disposal of the waste after it is collected.

The waste disposal system may additionally include a scoop. The scoop may be used to scrape pet waste, or other trash into a bag disposed within the opening of the waste container. In some embodiments, the scoop may include curved prongs to better reach under the waste and lift it into the dog waste container.

In some embodiments, the waste disposal container and scoop may include handles having rings on the top portion. The rings may allow the dog waste container and the scoop to be hung up for storage. For example, the waste disposal container and scoop may be hung on a hook located in a garage, on a wall, etc. for storing the system when not in use.

Turning now to the drawings and referring initially to FIG. 1, a front perspective view of the dog waste system including a scoop 10 and the dog waste container 22 is illustrated. The scoop 10 may include a paddle portion 12 having multiple prongs 11. The paddle 12 may be connected to a handle 14 via a connection piece 20, the handle 14 may include a handgrip 16 and a ring 18.

The paddle 12 may be used to scoop dog waste from the ground (or other locations) into the waste container 22. In some embodiments, the paddle 12 and the prongs 11 may be slightly curved, helping the prongs 11 to slide underneath solid waste and scoop it onto the paddle 12. In these embodiments, the prongs 11 may also act to "rake" the waste into the waste container 22. In some embodiments, the paddle 12 and the prongs 11 may be manufactured as a single piece. In other embodiments, the paddle 12 and the prongs 11 may be separate construction pieces that may be assembled together. The paddle 12 and prongs 11 may additionally be constructed out of a variety of materials. For example, the paddle 12 and prongs 11 may be plastic, steel, aluminum or other durable materials. Additionally, in some embodiments the paddle 12 may be a solid member and have an substantially straight bottom and the prongs 11 may be omitted. In these embodiments, the paddle 12 may function as a shovel to scoop waste into the waste container 22.

The connection piece 20 connects the paddle 12 to the handle 14. In some embodiments, the connection piece 20 may be a screw, nail, bolt, fastener, or the like. In other embodiments, the handle 14 may be glued or adhered to the paddle 12, such that the connection piece 20 may be omitted. In yet other embodiments, the paddle 12 and the handle 14 may be formed integrally.

The handle 14 connects to the paddle 12 and allows a user to maneuver the paddle 12 to scoop waste. The handle 14 may be any length desired. For example, in some embodiments the handle 14 may be about 3.5 feet, such that the user can scoop waste from the ground while standing. However, in other embodiments, the handle 14 may be constructed to be shorter, such that the user bends down to reach the waste. In other embodiments, the handle 14 may be longer than 3.5 feet. Further, in some embodiments, the handle 14 may have multiple extensible and collapsible members that allow for the handle to be extended or retracted to achieve a desired length. In some embodiments, the extensible and collapsible members may be configured to lock when fully extended or fully collapsed. In other embodiments, they may be configured as lockable at any length.

The handle 14 may additionally include a handgrip 16. The handgrip 16 may be constructed out of plastic, wood, leather, rubber, or rubberized foam, for example, and provides an area for the user to grip the scoop 10. In some embodiments, the handgrip 16 may surround a portion of the handle 14, while in other embodiments, the handgrip may be configured to attach to the end of the handle.

The handgrip 16 may include ridges 17 or other indention features to help the user better secure the handgrip 16. In some embodiments, the handgrip 16 may be configured with a ring 18 located at a top portion of the handgrip 16. In some embodiments, the ring 18 may be located at the top of the handle 14. The ring 18 may be used to hang the scoop 10 in order to store the scoop 10, for example on a hook secured to a wall or a ceiling.

The waste container 22 shown in FIG. 1 includes a lid 30 and a handle 24 attached to the lid. The handle 24 may, in some embodiments, include a handgrip 26 and ring 28. The waste container 22 is attached at a rotation point 31 to a lid 30. The waste container 22 rotates at the rotation point 31 to open, providing a deposit area 38 for waste. In some embodiments, the lid 30 may partially cover the opening 38 when in a first position, whereas in a second position the lid 30 is rotated behind a back wall of the container 22 to unblock (i.e. open) the opening 38. In other embodiments, the lid 30 may fully cover the opening 38 when in the closed position.

The lid 30 may take a form to generally imitate or follow a shape of an outer back wall of the container 22 to help the lid to move freely throughout a range of motion. That is, the lid may be shaped so that it does not get stuck on the outer back wall of the container 22 when rotated towards the second position (i.e. when rotated to unblock the opening 38). In other embodiments, the lid 30 may be flat or otherwise differently shaped. For example, in some embodiments the waste container 22 may have a generally circular shape and the lid 30 may be partially convex, such that that it may shaped to substantially follow the shape of the waste container 22. The lid 30 and the waste container 22 may be constructed out of a similar material, and may be made out of a variety of materials, such as plastic, steel, aluminum, and so forth.

The rotation point 31 may include a fastener to secure the waste container 22 to the lid 30, while still allowing the waste container 22 to rotate relative to the lid 30. There may be a rotation point 31 for each sidewall of the lid 30, such that there may be two rotation points 31 connecting the lid 30 to the waste container 22.

In some embodiments, the handle 24 may be removably attached to the lid 30. For example, the lid 20 and handle 24 may be threaded such that the handle is received into the lid. In other embodiments, the lid 30 may be connected to the handle 24 with an adhesive, such as a glue, or through molding or other suitable coupling techniques.

The handle 24 allows a user to maneuver the waste container 22, in order to position the waste container 22 to receive pet waste. The handle 24 may be similar to the handle 14 of the scoop 10. For example, in some embodiments, both handles 14, 24 may be the same length, such that the waste system may be uniform in length. In other embodiments, the handle 24 for the waste container 22 may be a different length from the scoop 10 handle 14, such that the waste container 22 and the scoop 10 have different lengths. Both handles 14, 24 may be constructed out of similar materials and be similarly shaped. In some embodiments, the handle 24 may be made of a number of extensible and collapsible members so that the handle 24 may be extended or collapsed to a desired length. Additionally, in some embodiments, the handle 24 may be configured to lock when fully extended and/or when fully collapsed. In some embodiments, the handle 24 may include multiple separate rod or cylinder members that may be joined together. For example, the handle 24 may include at least one member having male threads located at one end and at least one member having female threads configured to receive the male threads. Thus, the multiple members may be joined together to form the handle 24.

Similarly, the handgrip 26 for the waste container 22 may be similar to the handgrip 16 for the scoop 10. For example, the handgrip 26 may include ridges 27 and be constructed out of a soft plastic, wood or other materials comfortable to be held by a user. In some embodiments, the handgrip 26 also may include a ring 28. The ring 28 may be used to hang the waste container 22 to a wall, etc. in order to store the waste container 22.

Figure 2:
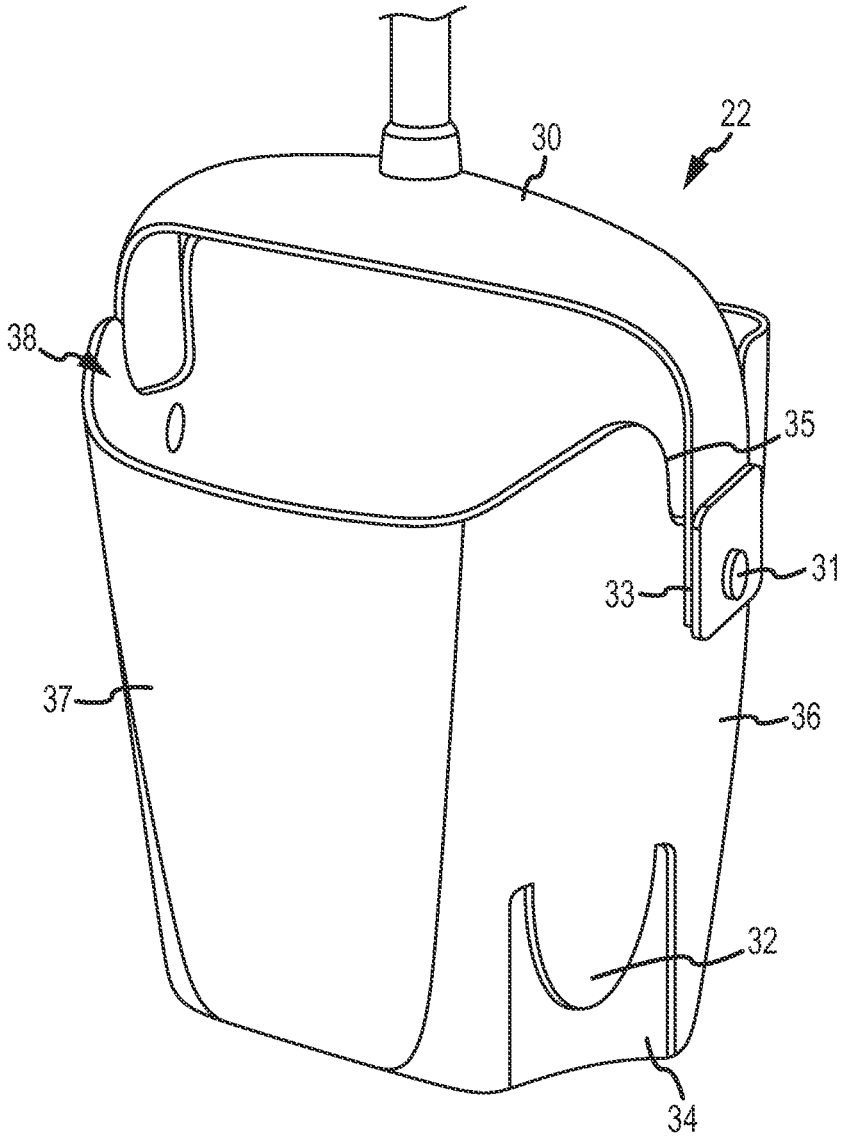
FIG. 2 is a front right enlarged perspective view of the waste container as illustrated in FIG. 1.
Figure 3:
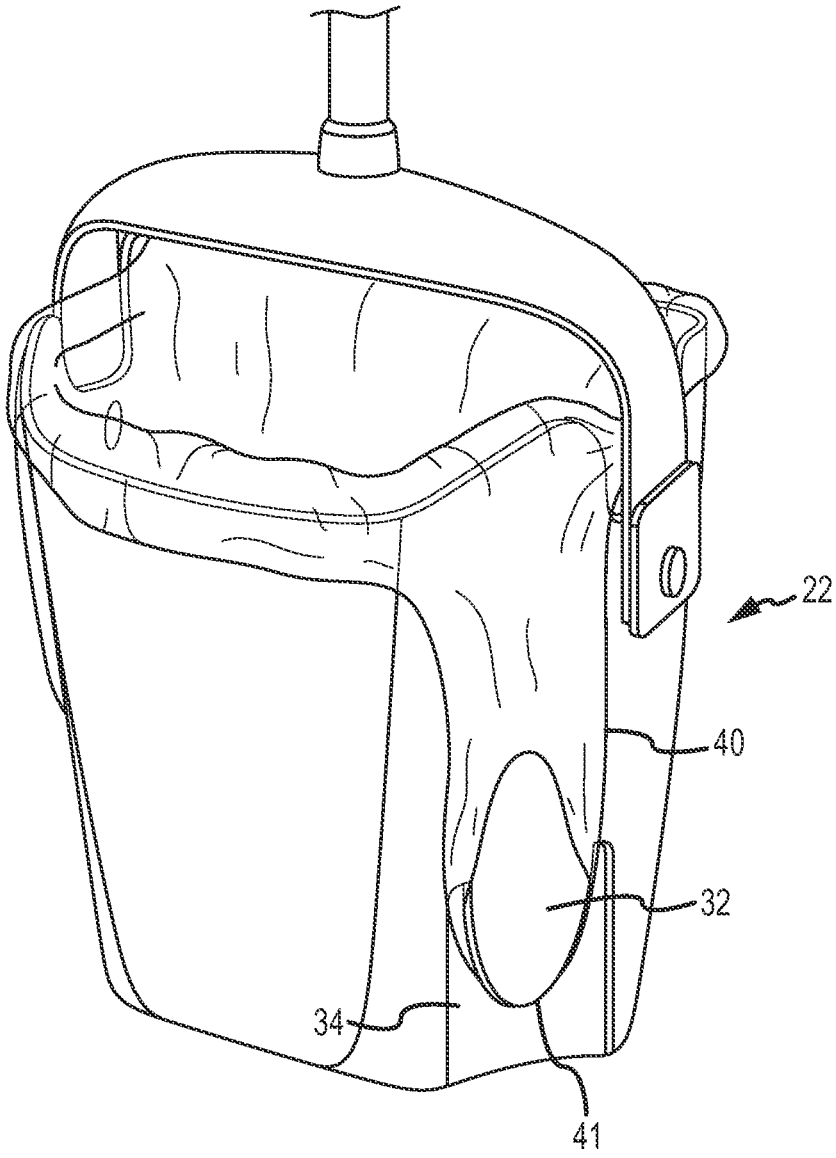
FIG. 3 is the same view as shown in FIG. 2, but additionally illustrating a bag secured to the waste container.
Figure 4:
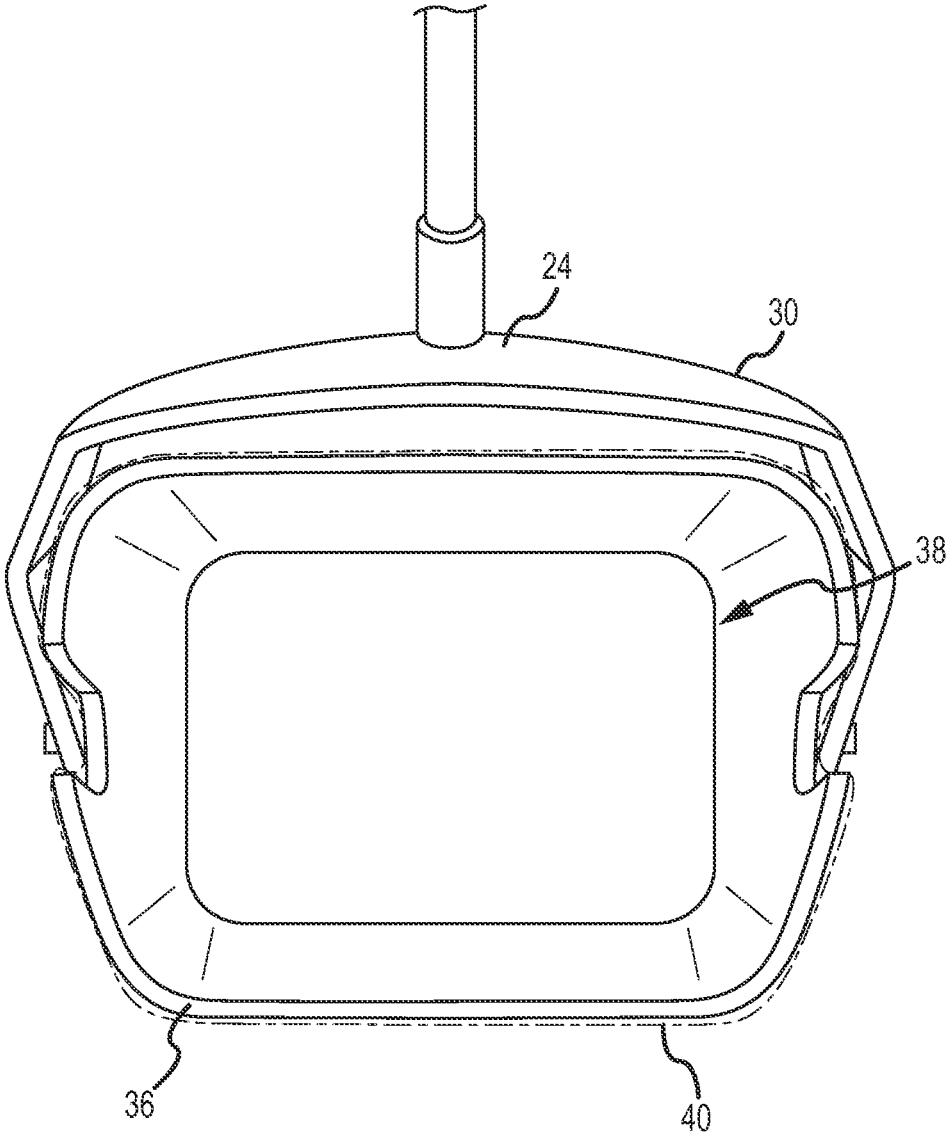
FIG. 4 is a front perspective view of the waste container illustrated in FIGS. 2 and 3 in an open position.

FIGS. 2 and 3 illustrate an enlarged view of the waste container 22. FIG. 4 illustrates the waste container 22 rotated to a second position, i.e. open, and includes a bag 40 secured to the container 22. Referring now to FIGS. 2 and 3, the waste container 22 includes two sidewalls 36 (only the right side shown) and a front wall 37 and a corresponding back wall (not shown). The walls 36, 37 create an opening 38 for receiving waste, such as dog waste, trash, etc. The sidewalls 36 also include engagement features 32 and engagement feature depressions 34. The engagement features 32 or hooks protrude away from the sidewalls 36 to create a hook-type shape. The engagement feature depressions 34 allow the engagement features 32 to have an open area between the sidewall 36, such that the engagement features 32 may be configured as an overhang for the sidewall 36. For example, the engagement features 32 may connect to the sidewalls 36 in one area, such that the handles of a bag may fit between the engagement features 32 and the sidewalls 36. In these embodiments, there is an open space between the engagement features 32 and the engagement feature depressions 34.

In other embodiments, the engagement features may take the form amenable to securing a bag without handles. For example, the engagement features may be configured to stab the bag to secure it through a side wall of the bag. In still other embodiments, a the engagement features may be configured to pinch a bag to secure the bag in place. As such, it should be appreciated that the engagement features may take various different forms.

The engagement features 32 may be used to secure a bag having handles, strings, etc. to the waste container 22. For example, the bag 40 may be a plastic or paper bag having handles 41, such as grocery bags. The engagement features 32 secure the bag 40, as the engagement feature depressions 34 create a space and allow handles of the bag 40 to hook around the engagement features 32. As may be apparent from FIG. 3, the handles 40 of the bag 40 are secured around the engagement features 32. The bag 41 then extends up the sidewall 36 and through a vertical aperture 33. This allows the bag 40 to be open in the opening 28, such that the bag 40 may receive waste. The vertical aperture 33 creates a partial wall 35 which supports the bag 40, and opens the bag 40 within the opening 28 by lifting the sides of the bag 40 upwards. The sides 41 of the bag 40 fit around and substantially covering the partial wall 35. Additionally, the bag 40 partially covers the front wall 37 and sidewall 36. These embodiments substantially prevent waste from contacting the walls 36, 37 when the user scoops waste into the waste container 22.

Referring now to FIGS. 1 and 4, the waste container 22 may be rotated from a substantially vertical position (illustrated in FIG. 1) to a substantially horizontal position (illustrated in FIG. 4). As shown in FIG. 4, the waste container 22 rotates along the rotation point 31 to lay horizontal. This embodiment allows the waste container 22 to be parallel and lay on the ground, allowing a user to scoop (via the scoop 10) waste into the waste container 22. The user places the paddle 12 of the scoop substantially parallel to the ground and the prongs 11 reach under the waste. Once the paddle 12 is partially under the waste the user may scoop it into the bag 40. Also, the paddle 12 may be used to rake the waste into the bag 40, as the container 22 may be flush with the ground.

As the waste container 22 is rotated, the partial wall 35 supports the bag 40, opening the bag 40 such that the bag 40 may receive the waste. When the waste container 22 rotates, the lid 30 is moved to be above the back wall of the waste container 22, unblocking the opening 38.

In these embodiments, the bag 40 is secured to the waste container 22 such that when the user scoops waste into the bag 40 waste is substantially prevented from coming into contact with the waste container 22. This helps to keep the waste container 22 clean from waste residue (and accompanying odors). Additionally, after the user has completed collecting the waste, the user may then remove the bag 40 from the engagement features 32 and throw it away. This makes waste disposal easy and substantially a cleaner process than the prior art.

Figure 5:
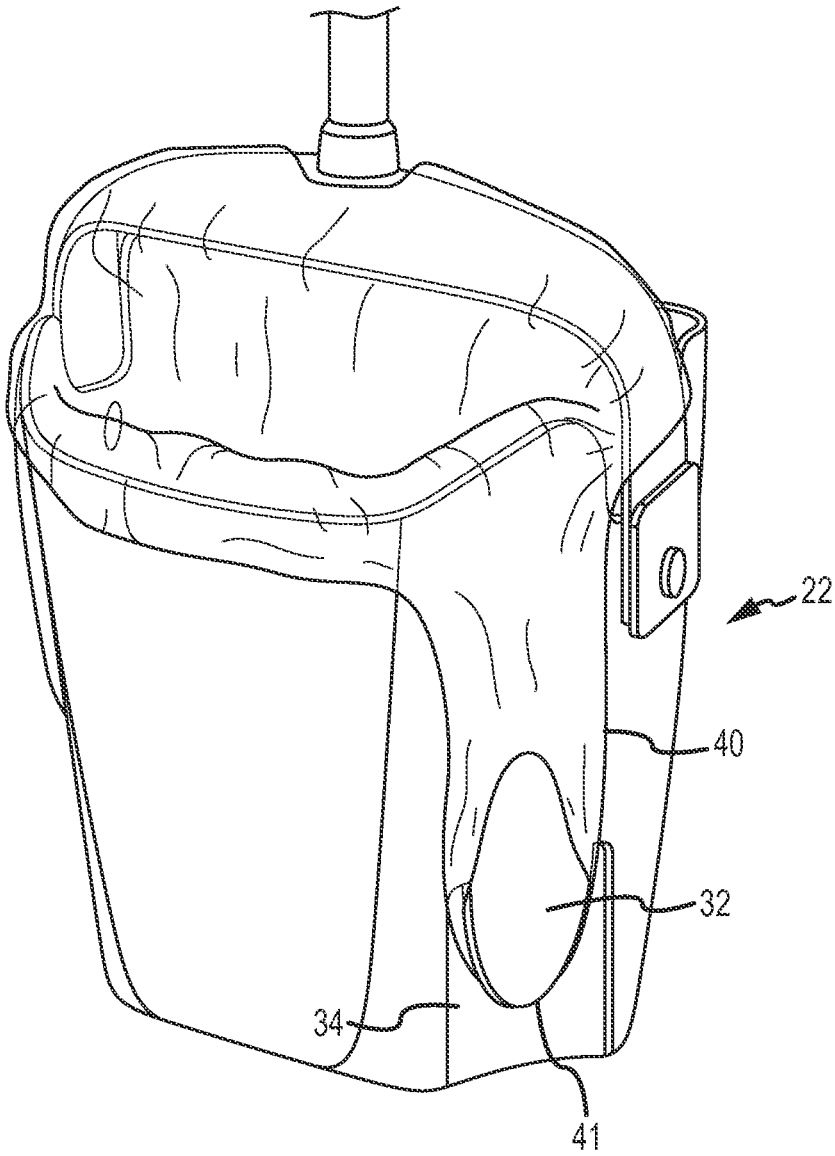
FIG. 5 is a front right enlarged perspective view of the waste container of FIG. 1 having a bag secured to the waste container to partially cover a lid of the waste container.

FIG. 5 illustrates an alternative bag configuration that allows for the bag to at least partially cover the lid 30. In particular, the bag 40 is extended up over the top of the lid 30 when secured to engagement feature. When the bag 40 is secured in this manner, the bag may serve to hold the waste container 22 and handle 24 in an upright position. That is, the bag helps to prevent the handle 24 from falling when standing unsupported.

Figure 6:
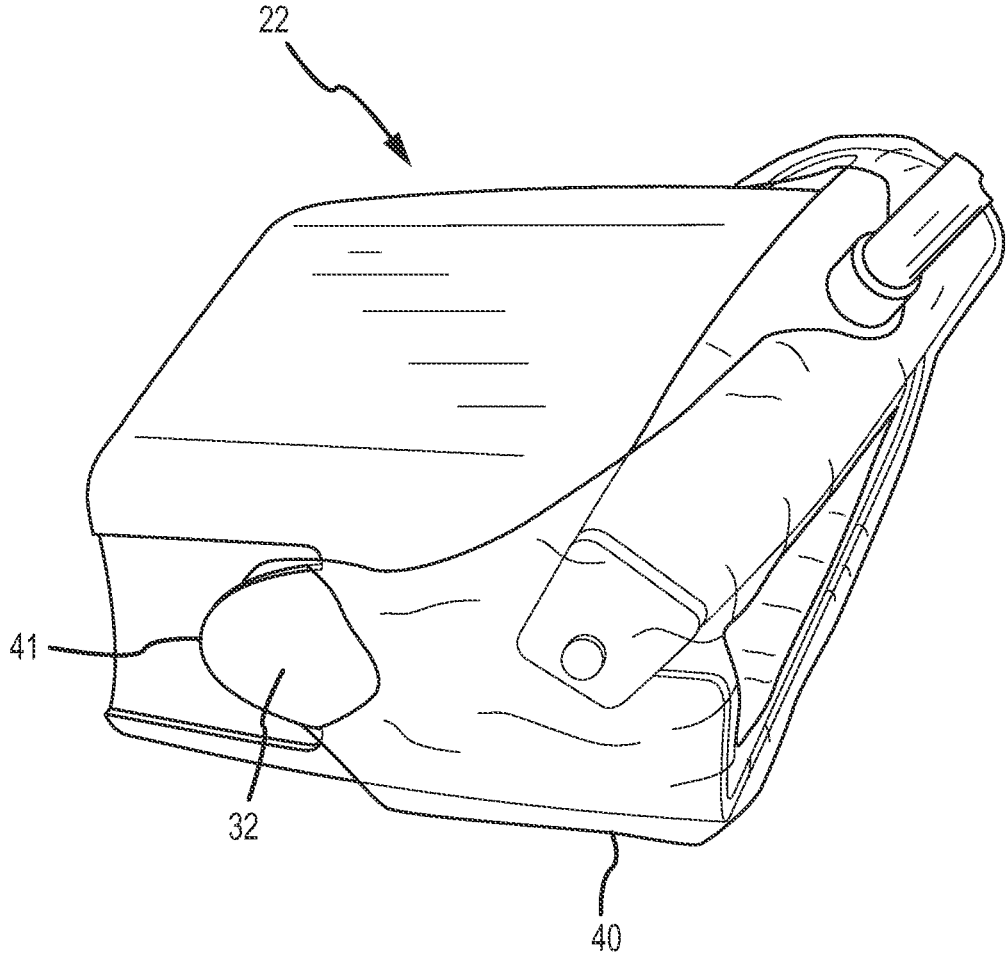
FIG. 6 illustrates the waste container of FIG. 1 in an open position with a bag secured to the waste container to partially cover a lid of the waste container.

FIG. 6 illustrates the waste container 22 with the lid 30 in an open position (i.e., when the waste container is lying on the ground to collect waste). As shown, the bag 40 remains at least partially covering the lid 30 while in the open position and thereby helps protect the lid 30 and the handle 24 from waste during the collection process. In particular, for example, when using the scoop 10 to collect pet waste from grass, the prongs 11 may become slightly tangled on the grass and, upon becoming untangled, the prongs may spring back into position and waste may splatter the waste collector. However, with the bag installed as illustrated in FIGS. 5 and 6, the waste will contact the bag 40 rather than the lid 30 or handle 24.

Figure 7:
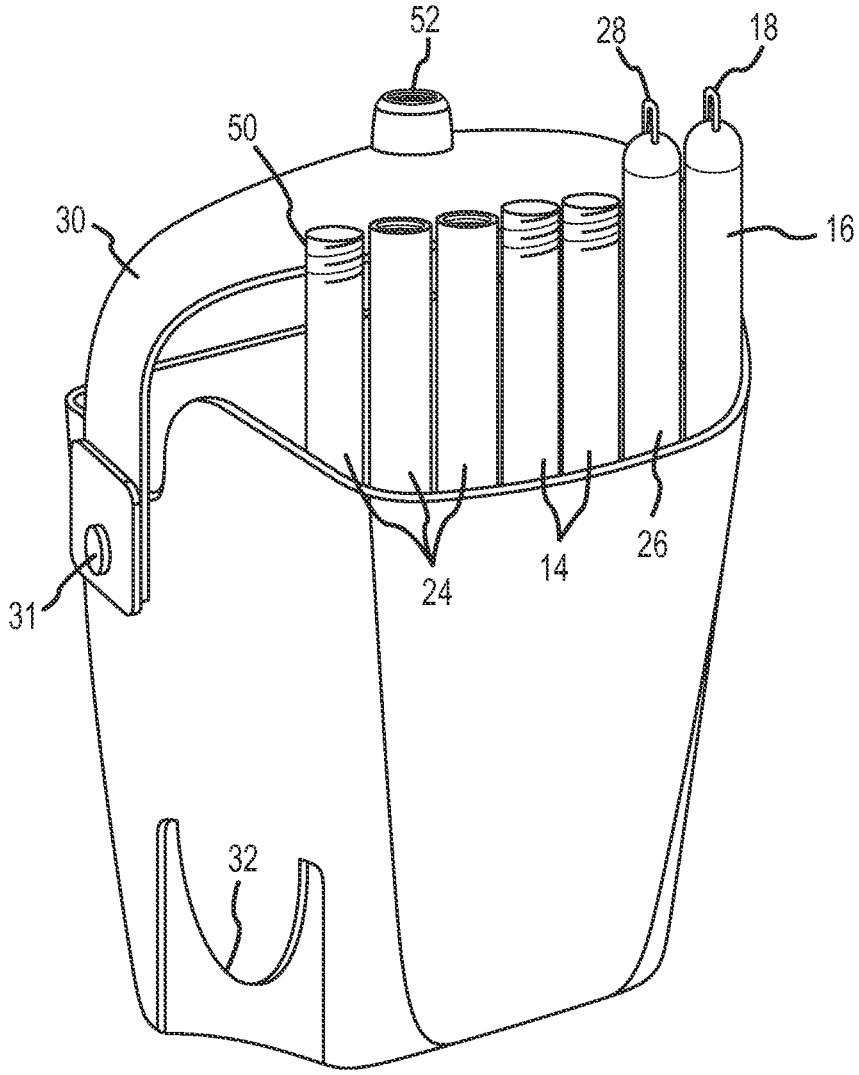
FIG. 7 illustrates an embodiment of the waste removal system of FIG. 1 disassembled using the container for storage of the handle and the scoop.

FIG. 7 illustrates an embodiment where the waste container 22 may serve as a storage for the handle 24 and the scoop 10. In particular, as shown, the handle 24 may be disassembled in some embodiments to allow for convenient storage within the waste container 22. Additionally, the scoop 10 may similarly be disassembled in some embodiments for storage. As shown in FIG. 5, the various member parts of the handles 24, 14 have threaded ends 50. Additionally, the lid has a threaded aperture 52 for receiving the handle 24. It should be appreciated that other attachment modes may be employed to couple the members together. For example, slot and groove techniques may be employed in some embodiments. Alternatively, in some embodiments, the handles 24, 14 may be collapsible and extendable and may be collapsed and placed inside the waste container 22 for storage.

Figure 8:
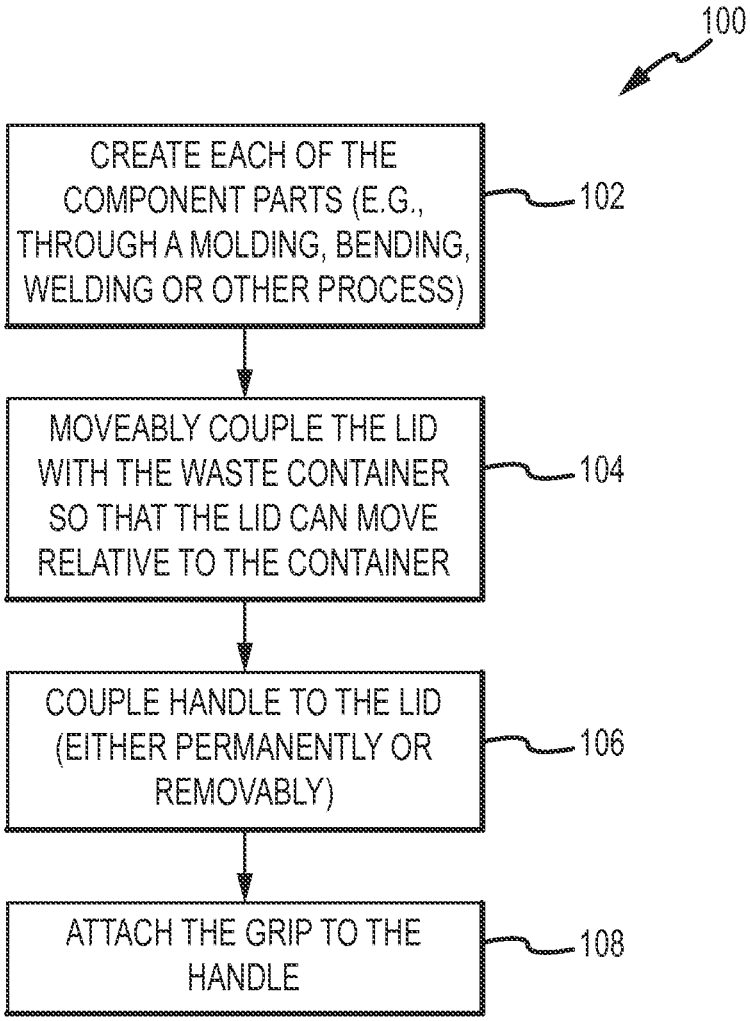
FIG. 8 is a flow chart illustrating an example method of manufacturing the waste removal system of FIG. 1.

FIG. 8 illustrates a method of manufacturing a waste container system in accordance with an illustrative embodiment. The method begins my creating the component parts (Block 102). The creation of the various components may include, for example, a plastic molding process, such as blow molding, injection molding or the like, and/or forming and joining metal, for example through a welding, cutting and/or bending process.

Once all of the component parts are created, they may be coupled together to create the waste container system. For example, the lid may be moveably coupled to the sidewalls of the container (Block 104). In some embodiments, this may include inserting bolts, nails or screws through the arms of the lid and the sidewalls, for example. The handle may then be attached to the lid (Block 106). In some embodiments the handle may be permanently affixed to the lid while in other embodiments, the handle may be removably attached to the lid (for example by threading the handle and the lid as explained above).

A grip may then be coupled to the handle (Block 108). The grip may take various different forms such as a leather or synthetic wrap, a rubber grip, a rubberized foam grip, or the like, that surrounds the handle. In other embodiments, the grip may be a hardened plastic, metal, wooden member or other material that may be attached to the handle either removably or permanently. For example, the grip may be attached to the handle using threads. In other embodiments, the grip may be fused to the handle, or attached with an interference fit, for example. It should be appreciated that the method 100 is presented in no particular order. Accordingly, the grip may be attached to the handle prior to coupling the handle to the lid, for example.

The foregoing describes some example embodiments to achieve a waste removal system for pets. Although the foregoing discussion has presented specific embodiments, persons skilled in the art will recognize that changes may be made in form and detail without departing from the spirit and scope of the embodiments. Indeed, in other embodiments, the waste disposal system may be used in other applications besides pet waste removal, for example in trash collection or sidewalk cleanup. Furthermore, although the waste container has been illustrated with the scoop, it should noted that both the scoop and the waste container may be used separately from each other. For example, the waste container may be used with a shovel or other tool to scoop waste into the container. Accordingly, the specific embodiments described herein should be understood as examples and not limiting the scope of the disclosure.

What is claimed is:

1. A pet waste removal system comprising:

a waste container comprising:

a first sidewall having a first depression formed therein and having a first hook disposed on an outer portion of the first sidewall and spaced from the first depression, a second sidewall having a second depression formed therein and having a second hook disposed on an outer portion of the second sidewall and spaced from the second depression, and a front wall and a back wall, wherein the front wall, the back wall, the first sidewall and the second sidewall define an opening;

a lid operatively connected to the waste container, wherein the waste container is configured to rotate relative to the lid and, wherein further, when the waste container is in a first position relative to the lid, the lid substantially covers the opening and when the waste container is in a second position relative to the lid, the lid opens the opening;

a handle operatively connected to a top portion of the lid;

wherein the handle further comprises a handgrip located at a top portion of the handle; and wherein the handgrip further comprises a ring located at a top portion of the handgrip.

2. The pet waste removal system of claim 1, further comprising a bag having a first handle and a second handle, wherein the first handle is secured around the first hook and the second handle is secured around the second hook.

3. The pet waste removal system of claim 1, wherein the waste container is plastic.

4. The pet waste removal system of claim 1, wherein when the waste container is in the first position, the waste container is substantially vertical and when the waste container is in the second position the waste container is substantially horizontal.

5. The pet waste removal system of claim 1, further comprising a scoop configured to scoop pet waste into the waste container.

6. The pet waste removal system of claim 5, wherein the scoop comprises:

a paddle including at least two prongs; and a scoop handle operatively connected to a top portion of the paddle.

7. The pet waste removal system of claim 6, wherein the scoop handle further comprises a scoop handgrip surrounding a top portion of the scoop handle.

8. The pet waste removal system of claim 1, further comprising:

a first fastener configured to secure the first sidewall to the lid; and a second fastener configured to secure the second sidewall to the lid.

9. The pet waste removal system of claim 1, wherein the front wall and back wall are substantially straight.

* * * * *

UNITED STATES PATENT AND TRADEMARK OFFICE

CERTIFICATE OF CORRECTION

PATENT NO. : 8,544,906 B2
APPLICATION NO. : 12/874980
DATED : October 1, 2013
INVENTOR(S) : Melaney Northrop et al.

It is certified that error appears in the above-identified patent and that said Letters Patent is hereby corrected as shown below:

Title page, second column, ABSTRACT, line 4, “a engagement” should read --an engagement--.

In the Specification
Column 1, line 42, “scraping” should read --scrape--.
Column 2, line 8, “is front” should read --is a front--.
Column 2, line 38, “waster” should read --waste--.
Column 2, line 42, “as a” should read --as--.
Column 3, line 6, “waster” should read --waste--.
Column 3, line 22, “, etc. for storing” should read --, etc., for storing--.
Column 3, line 45, “an substantially” should read --a substantially--.
Column 4, line 39, “such that that it may” should read --such that it may be--.
Column 5, line 19, “, etc. in order” should read --, etc., in order--.
Column 5, line 45, “a the engagement” should read --the engagement--.
Column 5, line 50, “, etc. to the” should read --, etc., to the--.
Column 5, line 56, “handles 40” should read --handles 41--.
Column 5, line 57, “bag 41” should read --bag 40--.
Column 5, line 63, “covering” should read --cover--.
Column 6, line 32, “to engagement” should read --to the engagement--.
Column 6, line 67, “my creating” should read --by creating--.
Column 7, line 39, “should noted” should read --should be noted--.

Signed and Sealed this
Thirty-first Day of December, 2013

Margaret A. Focarino

Margaret A. Focarino
*Commissioner for Patents of the United States Patent and Trademark Office*